US009199832B2

(12) United States Patent
Fracasso

(10) Patent No.: US 9,199,832 B2
(45) Date of Patent: Dec. 1, 2015

(54) FUNNEL KIT

(71) Applicant: Antonio Fracasso, Lasalle (CA)

(72) Inventor: Antonio Fracasso, Lasalle (CA)

( * ) Notice: Subject to any disclaimer, the term of this patent is extended or adjusted under 35 U.S.C. 154(b) by 267 days.

(21) Appl. No.: 13/850,553

(22) Filed: Mar. 26, 2013

(65) Prior Publication Data

US 2013/0299045 A1 Nov. 14, 2013

(30) Foreign Application Priority Data

May 11, 2012 (CA) ..... 2777005

(51) Int. Cl.
*B67C 11/02* (2006.01)
*B65B 39/06* (2006.01)
*B67C 9/00* (2006.01)

(52) U.S. Cl.
CPC ..... *B67C 11/02* (2013.01); *B65B 39/06* (2013.01); *B67C 9/00* (2013.01)

(58) Field of Classification Search
CPC ..... B65B 39/00; B65B 39/06; B67C 9/00; B67C 11/00; B67C 11/02
USPC ..... 141/331 R, 319, 331–332, 337, 141/363–364, 372
See application file for complete search history.

(56) References Cited

U.S. PATENT DOCUMENTS

| | | | | | |
|---|---|---|---|---|---|
| 2,773,521 | A * | 12/1956 | Persson | 141/5 |
| 3,156,272 | A * | 11/1964 | Indrunas | 141/286 |
| 3,261,381 | A * | 7/1966 | Roach | 141/114 |
| 3,615,150 | A * | 10/1971 | Indrunas | 141/375 |
| 3,620,267 | A * | 11/1971 | Seablom | 141/24 |
| 3,877,499 | A * | 4/1975 | Fluster | 141/310 |
| 3,945,617 | A * | 3/1976 | Callery | 366/347 |
| 3,963,063 | A * | 6/1976 | Pascarella | 141/309 |
| 4,217,941 | A * | 8/1980 | Catalano | 141/372 |
| 4,347,879 | A * | 9/1982 | Blaser | 141/364 |
| 4,454,897 | A * | 6/1984 | Valiant | 141/364 |
| 4,625,780 | A * | 12/1986 | Burnham | 141/319 |
| 5,490,545 | A * | 2/1996 | Sokoloff et al. | 141/319 |
| 5,794,904 | A * | 8/1998 | Hackley | 248/311.3 |
| 5,884,678 | A * | 3/1999 | Chudy | 141/319 |
| 5,918,650 | A * | 7/1999 | Borden | 141/383 |
| 5,964,260 | A * | 10/1999 | Chudy | 141/319 |
| 6,182,720 | B1 * | 2/2001 | Barnoski et al. | 141/375 |
| 6,260,590 | B1 * | 7/2001 | Ziegmann | 141/332 |
| 6,397,907 | B1 | 6/2002 | Heintz | |
| 6,418,987 | B1 * | 7/2002 | Colasacco | 141/384 |
| 6,745,802 | B2 * | 6/2004 | Varga | 141/319 |
| 7,198,080 | B2 * | 4/2007 | Foust | 141/386 |
| 7,967,040 | B1 * | 6/2011 | Sanford | 141/319 |
| 8,251,110 | B2 * | 8/2012 | Bassett et al. | 141/319 |
| 8,261,787 | B2 * | 9/2012 | Sanford | 141/319 |
| 2003/0010400 | A1 * | 1/2003 | Varga | 141/383 |
| 2007/0277902 | A1 * | 12/2007 | Dieudonat et al. | 141/319 |
| 2011/0155281 | A1 * | 6/2011 | Sanford | 141/375 |
| 2011/0253259 | A1 * | 10/2011 | Sanford | 141/319 |
| 2012/0298659 | A1 * | 11/2012 | Bogner | 220/200 |

* cited by examiner

*Primary Examiner* — Nicolas A Arnett

(57) ABSTRACT

A funnel kit used to transfer liquids such as ketchup, shampoo, oil, etc., from one bottle to another bottle. It functions like a funnel but its structure and material composition (plastic/rubber) allows it to hold both bottles so that they would stay in place. Usually, the top bottle has very little liquid and the bottom bottle is almost full. The weight of the fuller bottom bottle would insure that the system would not topple over. This saves the unused liquid instead of throwing it out. Combining several similar devices allows for the transfer of viscous liquid from a smaller bottle to a bigger bottle and vice-versa.

20 Claims, 5 Drawing Sheets

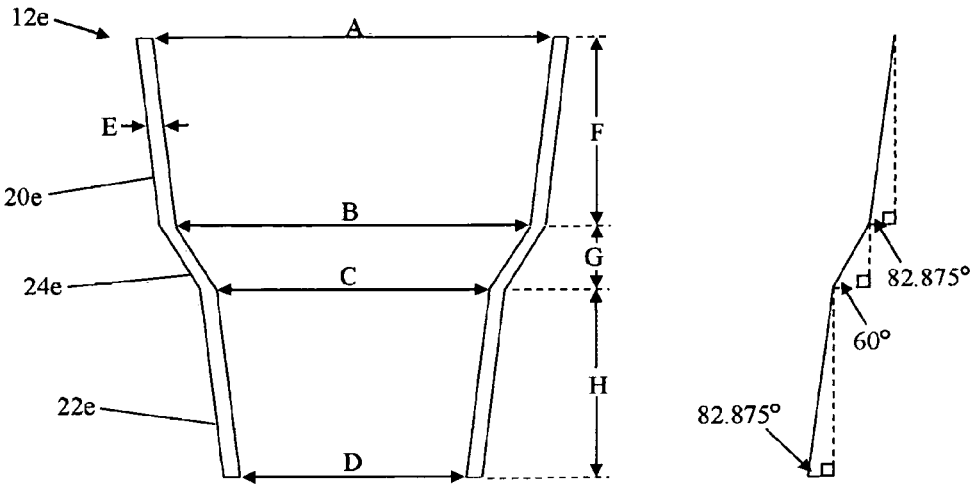
FIG. 3
| | Piece 1 | Piece 2 | Piece 3 | Piece 4 | Piece 5 |
|---|---|---|---|---|---|
| A | 975 | 1075 | 1175 | 1275 | 1375 |
| B | 825 | 925 | 1025 | 1125 | 1225 |
| C | 575 | 675 | 775 | 875 | 975 |
| D | 425 | 525 | 625 | 725 | 825 |
Table 1
FIG. 10
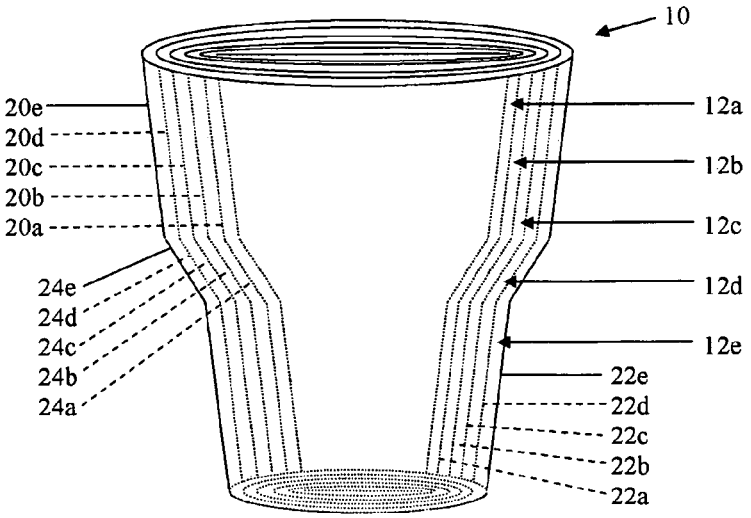
FIG. 4

| Bottom Piece | Top Piece | Sequence |
|---|---|---|
| 1 | 5 | 12a → 12d → 12c → 12b → 12e (see fig. 9) |
| | 4 | 12a → 12d (see fig. 7) |
| | 3 | 12a → 12d → 12c |
| | 2 | 12a → 12d → 12c → 12b |
| 2 | 5 | 12b → 12e (see fig. 8) |
| | 4 | 12b → 12e → 12d |
| | 3 | 12b → 12e → 12d → 12c |
| 3 | 5 | 12c → 12b → 12e |
| | 4 | 12c → 12b → 12e → 12d |
| 4 | 5 | 12d → 12c → 12b → 12e |
Table 2
FIG. 11
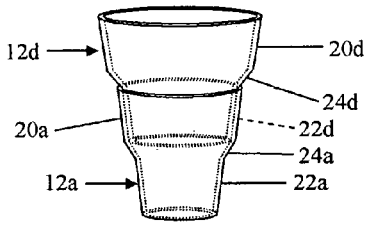
FIG. 7
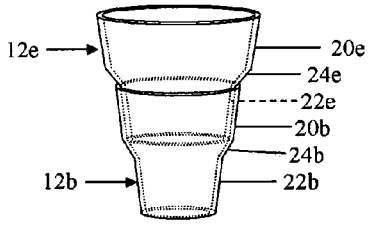
FIG. 8
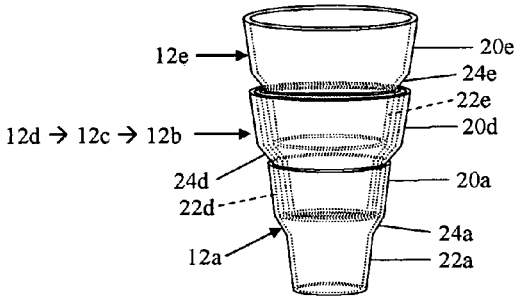
FIG. 9

FUNNEL KIT

FIELD OF THE INVENTION

The present invention relates generally to the field of fluid transfer between containers, and more particularly to a funnel kit.

BACKGROUND

When small amounts of viscous liquids are left in a bottle, such as Ketchup, the remaining substance cannot be emptied in a reasonable amount of time. You would need to hold the bottle upside down for a long duration to completely empty it. This could take hours. Usually, the small amount remaining is thrown out causing waste and a loss of money.

Some inventions have been designed to remedy this problem but none have gone to market because they would be expensive to manufacture, over-designed or not very versatile. The following are all United States patents that show one of more of these defects: U.S. Pat. No. 3,877,499 to Alfred Fluster, U.S. Pat. No. 3,963,063 to Robert S. Pascarella, U.S. Pat. No. 4,217,941 to Vitale Catalano and U.S. Pat. No. 4,347,879 to Anton J. Blaser. Some cannot transfer viscous liquids from two bottles of different sizes or use bottles with short necks, such as shampoo bottles. Most of those inventions only suit long neck bottles such as the ketchup bottle.

Against this background, there exist a need for an improved device for transferring fluids between containers.

It is a general object of the present invention to provide such an improved device.

SUMMARY OF THE INVENTION

In a broad aspect, the invention provides a funnel kit, the funnel kit comprising: a first funnel, the first funnel defining opposed first funnel first and second ends and a first funnel passageway extending therebetween, the first funnel also defining a first funnel first end section extending from the first funnel first end, a longitudinally opposed first funnel second end section extending from the first funnel second end, and a first funnel middle section extending between the first funnel first and second end sections, the first funnel passageway being of smaller transversal cross-sectional area at the first funnel second end than at the first funnel first end; and a second funnel, the second funnel defining opposed second funnel first and second ends and a second funnel passageway extending therebetween, the second funnel also defining a second funnel first end section extending from the second funnel first end, a longitudinally opposed second funnel second end section extending from the second funnel second end, and a second funnel middle section extending between the second funnel first and second end sections, the second funnel passageway being of smaller transversal cross-sectional area at the second funnel second end than at the second funnel first end. The first and second funnels are configurable between a first configuration and a second configuration, wherein, in the first configuration, the second funnel is inserted in the first funnel such that the second funnel first and second end sections are respectively inside the first funnel first and second end sections; and in the second configuration, the first funnel is partially inserted in the second funnel such that the first funnel second end section is in the second funnel first end section and the first funnel first end section protrudes from the second funnel.

In some embodiments, the first and second funnels are spaced apart from each other in the first configuration, the funnel kit further comprising at least one additional funnel positioned between the first and second funnels in the first configuration.

In some embodiments, the first and second funnels are resiliently deformable. For example, the first and second funnels are made of rubber.

In some embodiments, the first and second funnel first and second end sections are substantially frusto-conical and taper in a direction leading from respectively the first and second funnels first ends towards respectively the first and second funnels second ends.

In some embodiments, the first and second funnel middle sections are substantially frusto-conical and taper in a direction leading respectively from the first and second funnels first ends towards respectively the first and second funnels second ends, the first and second funnel middle sections tapering with a larger angle with a longitudinal axis of the first and second funnels than the first and second funnel first and second end sections.

In some embodiments, in the second configuration, the first funnel second end section is snugly fitted in the second funnel first end section.

In some embodiments, the kit comprises a plurality of funnels, each of the funnels being hollow and defining a funnel passageway, each of the funnels including a funnel first end section, an opposed funnel second end section and a funnel middle section extending therebetween, the plurality of funnels including the first and second funnels, the plurality of funnels including a largest funnel, the plurality of funnels being configurable to a compact configuration in which the funnels from the plurality of funnels are positioned one inside the other so that the plurality of funnels except the largest funnel are all inserted in the largest funnel.

In some embodiments, the funnels from the plurality of funnels are snugly fitted to each other in the compact configuration.

In some embodiments, the funnel middle sections of all of the funnels from the plurality of funnels are shorter than the funnel first and second end sections of all of the funnels from the plurality of funnels. In a specific embodiment, funnel middle sections are about 0.2 inches in length and the funnel first and second end sections are about 0.6 inches in length. In a specific embodiment, the funnel middle section has an aperture of about 60 degrees. In a specific embodiment, the funnel first and second end sections have an aperture of about 14.25 degrees.

In some embodiments, all of the funnels from the plurality of funnels are similarly shaped.

In some embodiments, all of the funnels from the plurality of funnels each include a funnel peripheral wall surrounding the funnel passageway and having a peripheral wall thickness, the funnel peripheral walls each having an outer dimension at each longitudinal position therealong that differs by an integer multiple of twice the peripheral wall thickness from an outer dimension of all the other ones of the funnel peripheral walls at a corresponding longitudinal position therealong.

In some embodiments, the funnel peripheral walls each have an outer dimension at each longitudinal position therealong in the funnel first end section that differs by an integer multiple of twice the peripheral wall thickness from an outer dimension at a corresponding longitudinal position in the funnel second end section.

This invention uses a device that works like a funnel which holds two bottles when transferring viscous liquids from a nearly empty top bottle to a nearly full bottom bottle. Because of its structure and material that has rubbery and elastic characteristics, the two bottles will stay in place when the device is forcefully inserted in the bottom bottle and the top bottle is forcefully inserted in it. The material may advantageously also be non toxic so that edible food can be transferred.

The bottom bottle is usually almost full and its weight will ensure that the structure will not topple over. The design of the device also ensures that bottles with short necks can be used. Shampoo bottles would fall into this category.

The basic shape of the device is repeated into smaller and bigger sizes. Combining the similar devices allows us to transfer viscous liquids from two bottles of different sizes. When transferring viscous liquid from an almost empty bottle to a fuller bottle the amount of liquid in the emptier bottle will not create a blockage where the two bottles meet due to the small amount of liquid being transferred and its speed. This will permit for an opening to exist, allowing the air to be displaced from the fuller bottle to the emptier bottle. Once the setup is done, the user can leave the structure in place and after an hour or so, all of the substance of the top bottle will be displaced to the bottom bottle.

Other objects, advantages and features of the present invention will become more apparent upon reading of the following non-restrictive description of some embodiments thereof, given by way of example only with reference to the accompanying drawings.

BRIEF DESCRIPTION OF THE DRAWINGS

FIG. 3, in a cut-away view, illustrates various parameters of the funnel shown in FIG. 1;

FIG. 4, in a perspective view, illustrates all the funnels part of the funnel kit inserted in one another in a compact configuration;

FIGS. 7 to 9 illustrate various stacking arrangements for the funnels of the funnel kit shown in FIG. 4;

FIG. 10, in a table, illustrates table 1 which includes exemplary measurements of the various funnels composing a funnel kit in accordance with the present invention; and FIG. 11, in a table, illustrates table 2 which illustrates various stacking arrangements achievable using the funnel kit detailed in table 1 of FIG. 10.

DETAILED DESCRIPTION

Figure 1:
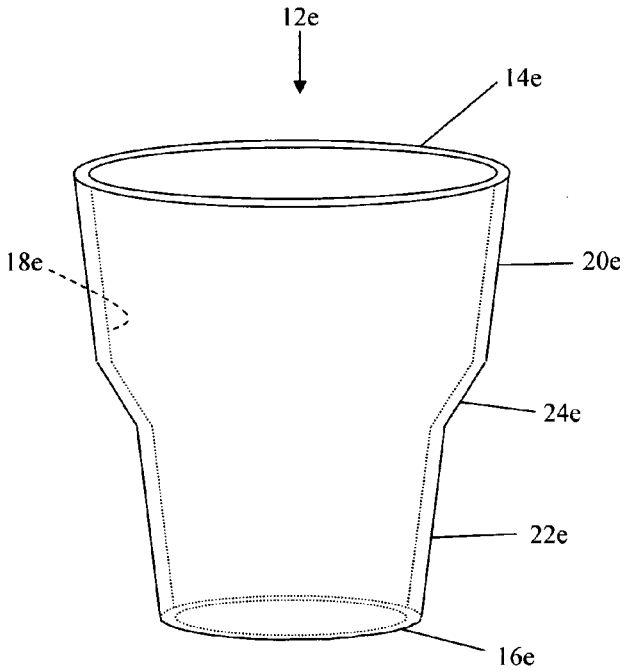
FIG. 1, in a perspective view, illustrates an embodiment of a funnel part of a funnel kit in accordance with the present invention.

The present invention concerns a funnel kit 10, shown for example in FIG. 4. The funnel kit 10 includes at least two, and typically more than two funnels. The funnel kit 10 shown in the drawings includes five funnels 12*a*, 12*b*, 12*c*, 12*d* and 12*e*. Typically, the funnels 12*a* to 12*e* all have the same shape and differ only in size.

In this document, the terminology "substantially" and "about" is used to denote variations in the thus qualified terms that have no significant effect on the principle of operation of the invention. These variations may be minor variations in design or variations due to mechanical tolerances in manufacturing and use of the various components of the invention. These variations and their effects are to be understood from the point of view of a person skilled in the art to which the present invention relates.

Referring to FIG. 1, funnel 12*e* is shown and its structure is described in further details. Since all the funnels 12*a* to 12*e* are similar in shape, only the funnel 12*e* is described in details herein, with the understanding that the other funnels are similar. Also, to simplify the description of the present invention, structures related to one of the specific funnel 12X, with X taking values a, b, c, d and e are denoted with a final letter corresponding to the specific funnel. For example, since FIG. 1 illustrates the funnel 12*e*, all the sub-elements of funnel 12*e* will have a letter "e" in their corresponding reference numerals. If similar structures for other funnels are used in the present description, they will have this letter "e" changed by the appropriate letter without needing formal description of all the funnels 12*a* to 12*d*. While specific funnels 12*a* to 12*e* are described hereinbelow, funnels having other shapes are also possible.

The funnel 12*e* defines opposed funnel first and second ends 14*e* and 16*e* and a funnel passageway 18*e* extending therebetween. The funnel 12*e* also defines a funnel first end section 20*e* extending from the funnel first end 14*e*, a longitudinally opposed funnel second end section 22*e* extending from the funnel second end 16*e*, and a funnel middle section 24*e* extending between the funnel first and second end sections 22*e* and 24*e*. The funnel passageway 16*e* is of smaller transversal cross-sectional area at the funnel second end 16*e* than at the funnel first end 14*e*. Typically, the funnels 12*a* to 12*e* are resiliently deformable. This is achieved for example by manufacturing the funnels 12*a* to 12*e* with rubber.

Returning to the description of the specific funnel 12*e*, the funnel first and second end sections 20*e* and 22*e* are substantially frusto-conical and taper in a direction leading from the funnel first end 14*e* towards the funnel second end 16*e*. Also, the funnel middle section 24*e* is substantially frusto-conical and tapers in a direction leading from the funnel first end 14*e* towards the funnel second end 16*e*. Therefore, the funnel 12*e* continuously reduces in diameter from the funnel first end 14*e* to the funnel second end 16*e*.

The funnel middle section 24*e* tapers with a larger angle than the funnel first and second end sections 20*e* and 22*e*. In other words, the diameter of the funnel middle section 24*e* decreases more rapidly than the diameter of the funnel first and second end sections 20*e* and 22*e* for each unit displacement along the funnel 12*e* towards the funnel second end 16*e*. Typically, the funnel middle section 24*e* is shorter than the funnel first and second end sections 20*e* and 22*e*.

The funnels kit 10 includes a largest funnel, in the example shown in the drawings funnel 12*e*. The funnels 12*a* to 12*e* are configurable to a compact configuration in which the funnels 12*a* to 12*e* are positioned one inside the other so that the funnels 12*a* to 12*d*, that is all the funnels 12*a* to 12*e* except the largest funnel 12*e*, are all inserted in the largest funnel 12*e*. The compact configuration is shown in FIG. 4. Typically, the funnels 12*a* to 12*e* are snugly fitted to each other in the compact configuration. In the compact configuration, the funnel first end sections 20*a* to 20*d* of the funnels 12*a* to 12*d* are all in the funnel first end section 20*e* of the funnel 12*e*, and the funnel second end sections 22*a* to 22*d* of the funnels 12*a* to 12*d* are all in the funnel second end section 22*e* of the funnel 12*e*.

In a specific example, the funnel middle section 24*e* is about 0.2 inches in length and the funnel first and second end sections 20*e* and 22*e* are about 0.6 inches in length. Also, the funnel middle section has an aperture of about 60 degrees and the funnel first and second end sections 20*e* and 22*e* have an aperture of about 14.25 degrees. The aperture is the conventional aperture for cones, that is the angle between opposed generatrix lines thereof, the cone being the cone from which a frustum is taken to obtain the different parts of the funnels 12*a* to 12*e*.

Figure 2:
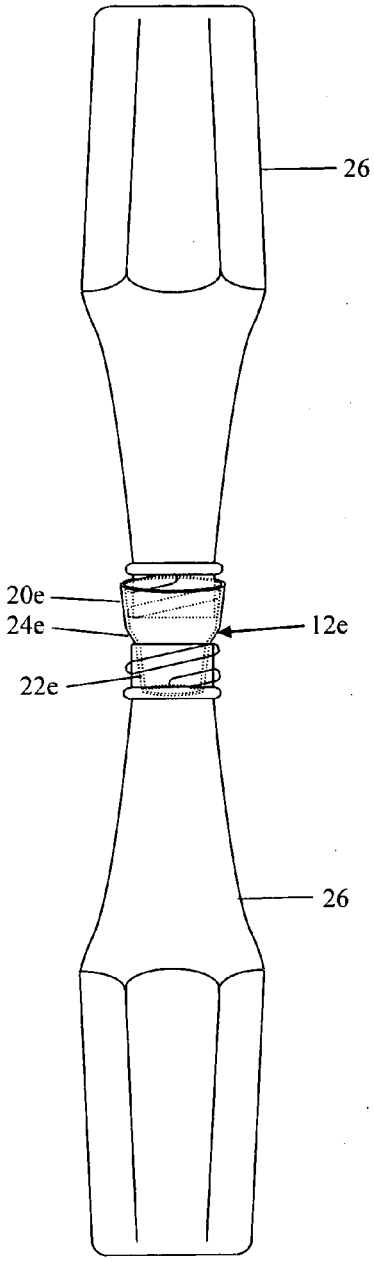
FIG. 2, in a perspective view, is an example of how the funnel shown in FIG. 1 is used.

As shown in FIG. 2, the funnel 12*e* can be used by itself to interconnect two bottles 26 of similar dimensions neck-to-neck to transfer liquids therebetween. However, the funnel kit 10 is particularly advantageous as it allows also interconnecting bottles having different dimensions.

Figure 5:
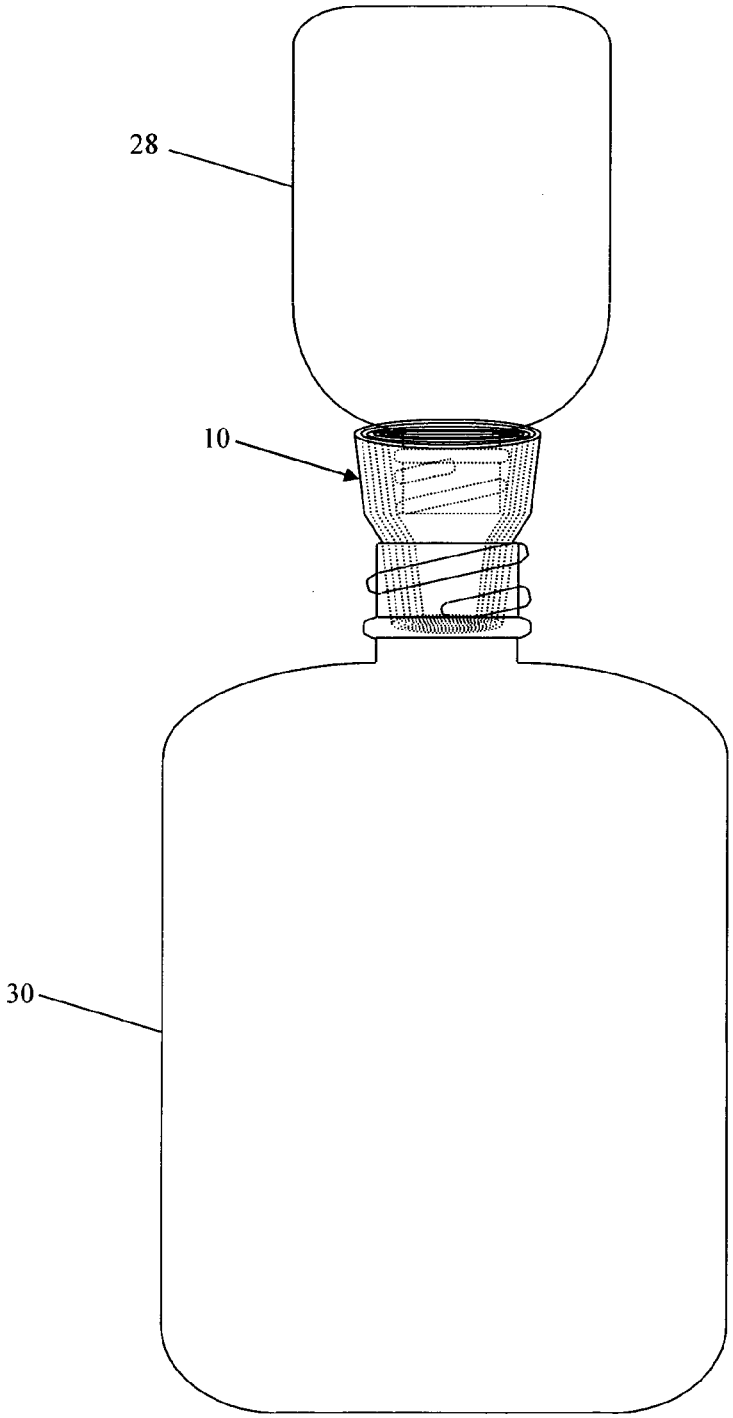
FIG. 5, in a perspective view, illustrates an example of transfer of a liquid from a smaller bottle to a bigger bottle using the funnel kit shown in FIG. 4.

For example, FIG. 5 illustrates using all the funnels 12*a* to 12*e*, in other words the whole funnel kit 10 in the compact configuration, to interconnect a small bottle 28 and a large bottle 30 neck-to-neck. Using suitable subsets of the funnels 12*a* to 12*e* brings flexibility to the dimensions of the bottles 28 and 30 that can be interconnected in this manner.

Figure 6:
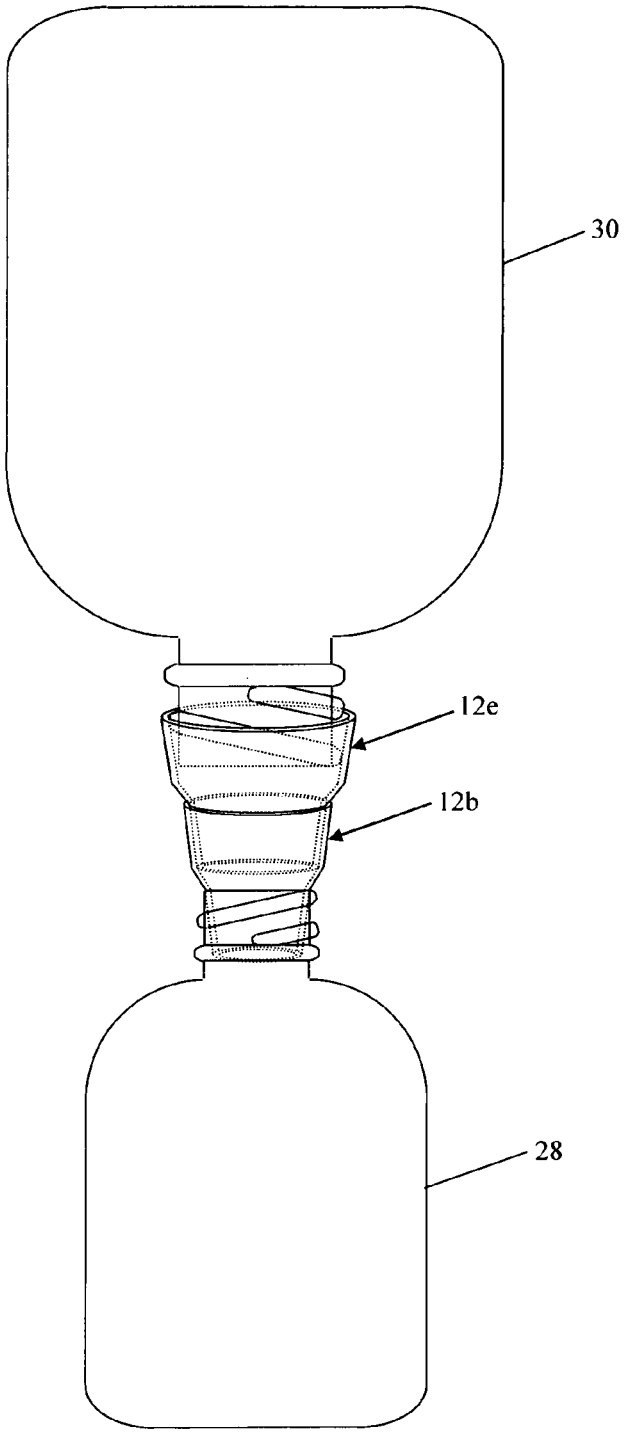
FIG. 6, in a perspective view, illustrates an example of transfer of a liquid from a larger bottle to a smaller bottle using the funnel kit shown in FIG. 4.

FIG. 6 illustrates another configuration in which funnel 12*e* and funnel 12*b* are assembled to transfer a fluid from the larger bottle 30 to the smaller bottle 28. In this configuration, the funnel 12*e*, that is the larger funnel, is partially inserted in the funnel 12*b*, that is the smaller funnel, such that the funnel second end section 22*e* is in the funnel first end section 20*b*, and typically snugly fitted therein, and the funnel first end section 20*e* protrudes from the funnel 12*b*. This configuration is illustrated in FIG. 8 and also in FIG. 7 for the funnels 12*a* and 12*d*. It should be notes that the funnels 12*b* and 12*e* are spaced apart from each other in the compact configuration, with at least one additional funnel, in this specific case funnels 12*c* and 12*d*, positioned therebetween. In other words, the funnels 12*b* and 12*e* are not immediate successors in size in the funnel kit 10.

In yet another configuration, the two configurations described above are mixed. For example, in FIG. 9, funnels 12*b*, 12*c* and 12*d* are in a compact configuration and together partially inserted in the funnel 12*a*. In turn, funnel 12*e* is partially inserted in funnel 12*b*.

To provide for stable arrangements, the funnel second end sections 22*a* to 22*e* that is inserted in a bottle, for example bottle 26, is forced therein. Also, the bottle, for example bottle 26, that is inserted in the funnel first end sections 20*a* to 20*e* is also forced therein. Since the funnel kit 10 is made of a rubbery/elastic material, not much force will be needed to achieve a secured fit. The top bottle 26 should be placed perpendicular to the ground to insure that the structure will not tip over. Once the setup is done, the transfer of viscous liquid from the top bottle to the bottom bottle will commence.

FIG. 3 illustrates the nomenclature used in Table 1 (shown in FIG. 10), which gives a specific example for dimensions of the funnels 12*a* to 12*e*. The thickness of the peripheral wall of the funnels 12*a* to 12*e*, E, is about 0.05 inches. The length of F and H is about 0.6 inches and the length of G is about 0.2 inches.

In order to transfer viscous liquids from different sized bottles 26, many funnels 12*a* to 12*e* of the same basic shape are needed. Table 1 specifies the inner diameters at various locations in the funnels 12*a* to 12*e* in an example of implementation. Note the difference between any adjacent cells in table 12 is twice E, which equals 0.1 if we use E equals 0.05.

More pieces, bigger or smaller can be added to Table 1, but the rule with adjacent cells being twice E must always be respected. This ensures that at each longitudinal location therealong, the funnels 12*a* to 12*e* differ in outer dimension by an integer multiple of twice E, with this integer multiple being one for successive funnels 12*a* to 12*e*.

Also, for each funnel 12*a* to 12*e*, the difference between A and C is equal to the difference between B and D, which is equal to an integer number times twice E. This ensures that at each longitudinal location therealong, the funnel first end section 20*a* to 20*e* differ in outer dimension by an integer multiple of twice E from an outer dimension of the corresponding funnel second end section 22*a* to 22*e*. This allows insertion of larger funnels in smaller funnels with a tight fit.

Table 2, shown in FIG. 11, illustrates how the various funnels 12*a* to 12*e* can be stacked so that a tight fit is achieved from a top funnel to a bottom funnel. In the sequence, a funnel to the right of the arrow is inserted in the funnel to the left of the arrow.

Although the present invention has been described hereinabove by way of preferred embodiments thereof, it can be modified, without departing from the spirit and nature of the subject invention as defined in the appended claims.

What is claimed is:

1. A funnel kit, said funnel kit comprising:

a first funnel, said first funnel defining opposed first funnel first and second ends and a first funnel passageway extending therebetween, said first funnel also defining a first funnel first end section extending from said first funnel first end, a longitudinally opposed first funnel second end section extending from said first funnel second end, and a first funnel middle section extending between said first funnel first and second end sections, said first funnel passageway being of smaller transversal cross-sectional area at said first funnel second end than at said first funnel first end; and a second funnel, said second funnel defining opposed second funnel first and second ends and a second funnel passageway extending therebetween, said second funnel also defining a second funnel first end section extending from said second funnel first end, a longitudinally opposed second funnel second end section extending from said second funnel second end, and a second funnel middle section extending between said second funnel first and second end sections, said second funnel passageway being of smaller transversal cross-sectional area at said second funnel second end than at said second funnel first end;

said first and second funnels being configurable between a first configuration and a second configuration, wherein, in said first configuration, said second funnel is inserted in said first funnel such that said second funnel first and second end sections are respectively inside said first funnel first and second end sections; and in said second configuration, said first funnel is partially inserted in said second funnel such that said first funnel second end section is in said second funnel first end section and said first funnel first end section protrudes from said second funnel.

2. The funnel kit as defined in claim 1, wherein in said first configuration, said first and second funnels are spaced apart from each other, said funnel kit further comprising at least one additional funnel positioned between said first and second funnels in said first configuration.

3. The funnel kit as defined in claim 1, wherein said first and second funnels are resiliently deformable.

4. The funnel kit as defined in claim 3, wherein said first and second funnels are made of rubber.

5. The funnel kit as defined in claim 1, wherein said first and second funnel first and second end sections are substantially frusto-conical and taper in a direction leading from respectively said first and second funnel first ends towards respectively said first and second funnel second ends.

6. The funnel kit as defined in claim 5, wherein said first and second funnel middle sections are substantially frusto-conical and taper in a direction leading respectively from said first and second funnel first ends towards respectively said first and second funnel second ends, said first and second funnel middle sections tapering with a larger angle with a longitudinal axis of said first and second funnels than said first and second funnel first and second end sections.

7. The funnel kit as defined in claim 1, wherein in said second configuration, said first funnel second end section is snugly fitted in said second funnel first end section.

8. The funnel kit as defined in claim 1, comprising a plurality of funnels, each of said funnels being hollow and defining a funnel passageway, each of said funnels including a funnel first end section, an opposed funnel second end section and a funnel middle section extending therebetween, said plurality of funnels including said first and second funnels, said plurality of funnels including a largest funnel, said plurality of funnels being configurable to a compact configuration in which said funnels from said plurality of funnels are positioned one inside the other so that said plurality of funnels except said largest funnel are all inserted in said largest funnel.

9. The funnel kit as defined in claim 8, wherein said funnels from said plurality of funnels are snugly fitted to each other in said compact configuration.

10. The funnel kit as defined in claim 8, wherein said funnels from said plurality of funnels are resiliently deformable.

11. The funnel kit as defined in claim 10, wherein said funnels from said plurality of funnels are made of rubber.

12. The funnel kit as defined in claim 8, wherein said funnel first and second end sections of all of said funnels from said plurality of funnels are substantially frusto-conical.

13. The funnel kit as defined in claim 12, wherein said funnel middle sections of all of said funnels from said plurality of funnels are substantially frusto-conical.

14. The funnel kit as defined in claim 13, wherein said funnel middle sections of all of said funnels from said plurality of funnels are shorter than said funnel first and second end sections of all of said funnels from said plurality of funnels.

15. The funnel kit as defined in claim 14, wherein said funnel first and second end sections have an aperture of about 14.25 degrees.

16. A funnel kit as defined in claim 13, wherein said funnel middle sections are about 0.2 inches in length and said funnel first and second end sections are about 0.6 inches in length.

17. The funnel kit as defined in claim 16, wherein said funnel middle section has an aperture of about 60 degrees.

18. The funnel kit as defined in claim 8, wherein all of said funnels from said plurality of funnels are similarly shaped.

19. The funnel kit as defined in claim 18, wherein all of said funnels from said plurality of funnels each include a funnel peripheral wall surrounding said funnel passageway and having a peripheral wall thickness, said funnel peripheral walls each having an outer dimension at each longitudinal position therealong that differs by an integer multiple of twice said peripheral wall thickness from an outer dimension of all the other ones of said funnel peripheral walls at a corresponding longitudinal position therealong.

20. The funnel kit as defined in claim 19, wherein said funnel peripheral walls each have an outer dimension at each longitudinal position therealong in said funnel first end section that differs by an integer multiple of twice said peripheral wall thickness from an outer dimension at a corresponding longitudinal position in said funnel second end section.

* * * * *